US005788421A

United States Patent [19]

Higashi et al.

[11] Patent Number: 5,788,421

[45] Date of Patent: Aug. 4, 1998

[54] BLOCKING AGENT FOR ROCK CRACKS AND METHOD OF BLOCKING ROCK CRACKS

[75] Inventors: Shoji Higashi, Kochi; Nakamichi Yamasaki, Kochi-ken; Hideaki Takahashi, deceased, late of Sendai, all of Japan, by Yukiko Takahashi, heir

[73] Assignee: President of Kochi University, Kochi, Japan

[21] Appl. No.: 898,927

[22] Filed: Jul. 23, 1997

Related U.S. Application Data

[63] Continuation of Ser. No. 566,994, Dec. 4, 1995, abandoned.

[30] Foreign Application Priority Data

May 16, 1995 [JP] Japan ..... 7-117210

[51] Int. Cl.[6] ..... E02D 3/12; E21B 33/138

[52] U.S. Cl. ..... 405/263; 106/900; 166/248; 166/292; 405/266

[58] Field of Search ..... 405/258, 263, 405/266, 269; 166/282, 283, 288, 292; 106/600, 900

[56] References Cited

U.S. PATENT DOCUMENTS

| | | | |
|---|---|---|---|
| 3,522,066 | 7/1970 | Forsyth | 106/600 |
| 3,936,383 | 2/1976 | Daimon et al. | 106/600 X |
| 4,455,171 | 6/1984 | Spensley et al. | 106/694 |
| 4,737,306 | 4/1988 | Wichelhaus et al. | 510/315 |
| 5,221,497 | 6/1993 | Watanabe et al. | 106/287.34 X |
| 5,569,323 | 10/1996 | Frouin et al. | 106/600 X |

FOREIGN PATENT DOCUMENTS

| | | |
|---|---|---|
| 52-142730 | 11/1977 | Japan . |
| 53-113825 | 10/1978 | Japan . |
| 58-185465 | 10/1983 | Japan . |
| 60-124690 | 7/1985 | Japan . |

*Primary Examiner*—George A. Suchfield

*Attorney, Agent, or Firm*—Oblon, Spivak, McClelland, Maier & Neustadt, P.C.

[57] ABSTRACT

Underground rock cracks are blocked by using a slurry of blocking agent containing hectorite raw materials in an amount of 1 to 10 wt %, which comprises an acidic precipitate of water glass and magnesium chloride, sodium hydroxide, and lithium hydroxide and water, through the steps of injecting the slurry, allowing the slurry to flow into the cracks produced in rocks, and allowing hectorite synthesized from the raw materials contained in the slurry to gel under high temperature conditions of underground.

4 Claims, 2 Drawing Sheets

BLOCKING AGENT FOR ROCK CRACKS AND METHOD OF BLOCKING ROCK CRACKS

This application is a continuation of application Ser. No. 08/566,994, filed on Dec. 4, 1995, now abandoned

BACKGROUND OF THE INVENTION

1. Field of the Invention

The present invention relates to geothermal technology, and more specifically, to an agent for blocking cracks artificially produced in the underground hot dry rocks in order to extract heat and a method of blocking the rock cracks using the agent.

2. Description of the Related Art

Recently, various developments have been made to extract heat from the hot dry rocks, which occur at depth of underground, as future methods of utilizing a geothermal energy. More specifically, there has been designed a method of producing artificial cracks in the underground hot dry rocks and injecting water from an injection well to recover hot water through a production well.

However, when the artificial cracks are made in the underground rocks, fine cracks are also produced over the entire rocks, so that the injected water may leak out through the fine cracks not part of a main path, lowering a recovery of the injected water. As a result, the overall efficiency of heat extracting system decreases.

SUMMARY OF THE INVENTION

Under the aforementioned circumstances, there has been a strong desire to develop an agent capable of blocking unnecessary artificial cracks produced in the hot dry rocks present at depth of underground.

The object of the present invention is to provide an agent capable of blocking artificial cracks produced in the underground hot dry rocks within a short time, and further to provide a method of blocking the rock cracks by using the blocking agent.

A blocking agent for underground rock cracks according to the present invention comprises an acidic precipitate of water glass and magnesium chloride, sodium hydroxide and lithium hydroxide as hectorite raw materials.

Furthermore, when used, a blocking agent for underground rock cracks according to the present invention is made of a slurry containing hectorite raw materials in an amount of 1 to 10 wt %, which comprises an acidic precipitate of water glass and magnesium chloride, sodium hydroxide, lithium hydroxide and water.

A method of blocking cracks artificially produced in the hot dry rocks present at depth of underground according to the present invention, comprising the steps of:

- injecting a slurry of blocking agent containing hectorite raw materials in an amount of 1 to 10 wt %, which comprises an acidic precipitate of water glass and magnesium chloride, sodium hydroxide, lithium hydroxide and water;
- allowing the slurry to flow into the cracks produced in the underground hot dry rocks; and
- allowing hectorite synthesized from the raw materials contained in the slurry to gel under high temperature conditions of underground, thereby blocking the cracks.

DETAILED DESCRIPTION OF THE PREFERRED EMBODIMENTS

Figure 1:
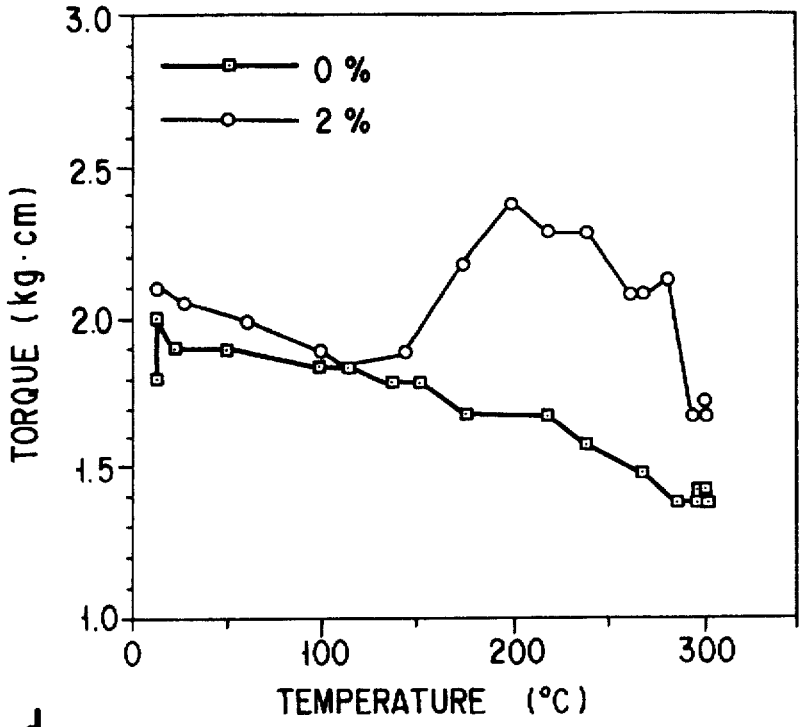
FIG. 1 is a diagram showing a relationship between temperature and torque when a blocking agent slurry of the present invention is subjected to hydrothermal treatment in the temperature range up to 300° C. in a mixing-type autoclave.

Hereinbelow, the present invention will be described in detail.

Hectorite for use in the present invention is a kind of smectite clay having a chemical composition of $Na_{0.2-0.5}(Mg_{2.5-2.8}Li_{0.2-0.5})Si_4O_{10}(OH)_2.nH_2O$ (an ideal ratio of Na:Mg:Li:Si is 0.33:2.67:0.33:4).

A blocking agent for underground rock cracks according to the present invention may be supplied either in powder or a slurry containing hectorite raw materials; however, the latter is of practical use. Therefore, when the blocking agent powder is supplied, the slurry is prepared on a working site.

The blocking agent for underground rock cracks according to the present invention contains hectorite raw materials made of an acidic precipitate of water glass and magnesium chloride, sodium hydroxide and lithium hydroxide corresponding with a desired hectorite composition. The blocking agent is used as a slurry containing hectorite raw materials in an amount of 1 to 10 wt %, which comprises an acidic precipitate of water glass and magnesium chloride, sodium hydroxide, lithium hydroxide and water.

The slurry is low in viscosity at a relatively lower temperature, but exhibits gelling properties with high viscosity when subjected to hydrothermal reaction at high temperature for 1 to 3 hours due to crystallization of hectorite. The effective gelling occurs in the underground temperature range from 200° to 250° C. in which geothermal energy is supposed to be preferably extracted. Therefore, the cracks of the underground rocks can be blocked by the steps of: injection of the present blocking agent slurry containing hectorite raw materials in an amount of 1 to 10 wt %, which comprises an acidic precipitate of water glass and magnesium chloride, sodium hydroxide, lithium hydroxide and water; allowing the slurry to flow into the cracks produced in the underground rocks; and allowing hectorite synthesized from the raw materials contained in the slurry to gel under high temperature conditions of underground.

Owing to its excellent rheological properties, conventional synthetic hectorite of a colloidal dispersion type has been industrialized and used as mud-water for deep underground boring in various countries. However, no technology is known other than that of the present invention which takes advantage of the feature in that the slurry viscosity greatly differs before and after hectorite formation. In addition, it is not the case with other smectite clays but the characteristic phenomenon with hectorite that the viscosity is raised in a short time due to crystallization and gelling.

Examples

Hereinbelow, examples of the present invention will be described in detail.

In accordance with the method disclosed by K. Torii, T. Iwasaki, SYNTHESIS OF HECTORITE, Clay Science (6), 1–16 (1987), starting slurry for hectorite was prepared as follows: In the first place, an Si-Mg solution having an Si/Mg ratio of ideal hectorite was prepared by mixing nitric acid dissolved water glass with an aqueous $MgCl_2$ solution. Subsequently, a homogeneous Si-Mg precipitate was allowed to generate in an aqueous NaOH solution. The homogeneous Si-Mg precipitate was filtrated and washed with distilled water to remove excess cations. Thereafter, the precipitate was mixed with an aqueous NaOH solution and an aqueous LiOH solution to obtain an ideal Na-hectorite composition, thereby finally prepared a slurry with hectorite concentration of 2%.

The slurry thus obtained was hydrothermally treated in the temperature range up to 300° C. using a mixing-type autoclave. At this time, viscosity behavior in the hectorite formation process was monitored by means of a torque meter attached to a screw rotation axis of the mixing-type autoclave. The result is shown in FIG. 1. For comparison, the result of a control sample consisting of water alone (concentration: 0%) is also shown in FIG. 1.

As evidenced in FIG. 1, the torque value representing the viscosity of the 2% slurry rapidly increases in the range from 150° to 200° C. and then slightly decreases in the range about 200° C. or more. However, the torque is maintained at a relatively high value in the range of about 200° to 250° C. The viscosity behavior of the 2% slurry greatly differs from that of the control sample, i.e., water (0% concentration). It is known that the viscosity behavior is related to the crystallization of hectorite and particle-size distribution. From these results, it is considered that preferable temperature conditions for blocking cracks are in the range of about 200° to 250° C. in which hectorite is formed to give high viscosity. This temperature range of about 200° to 250° C. is coincident with that in which heat extraction is supposed to be preferably performed from the hot dry rocks present at depth of underground.

Figure 2:
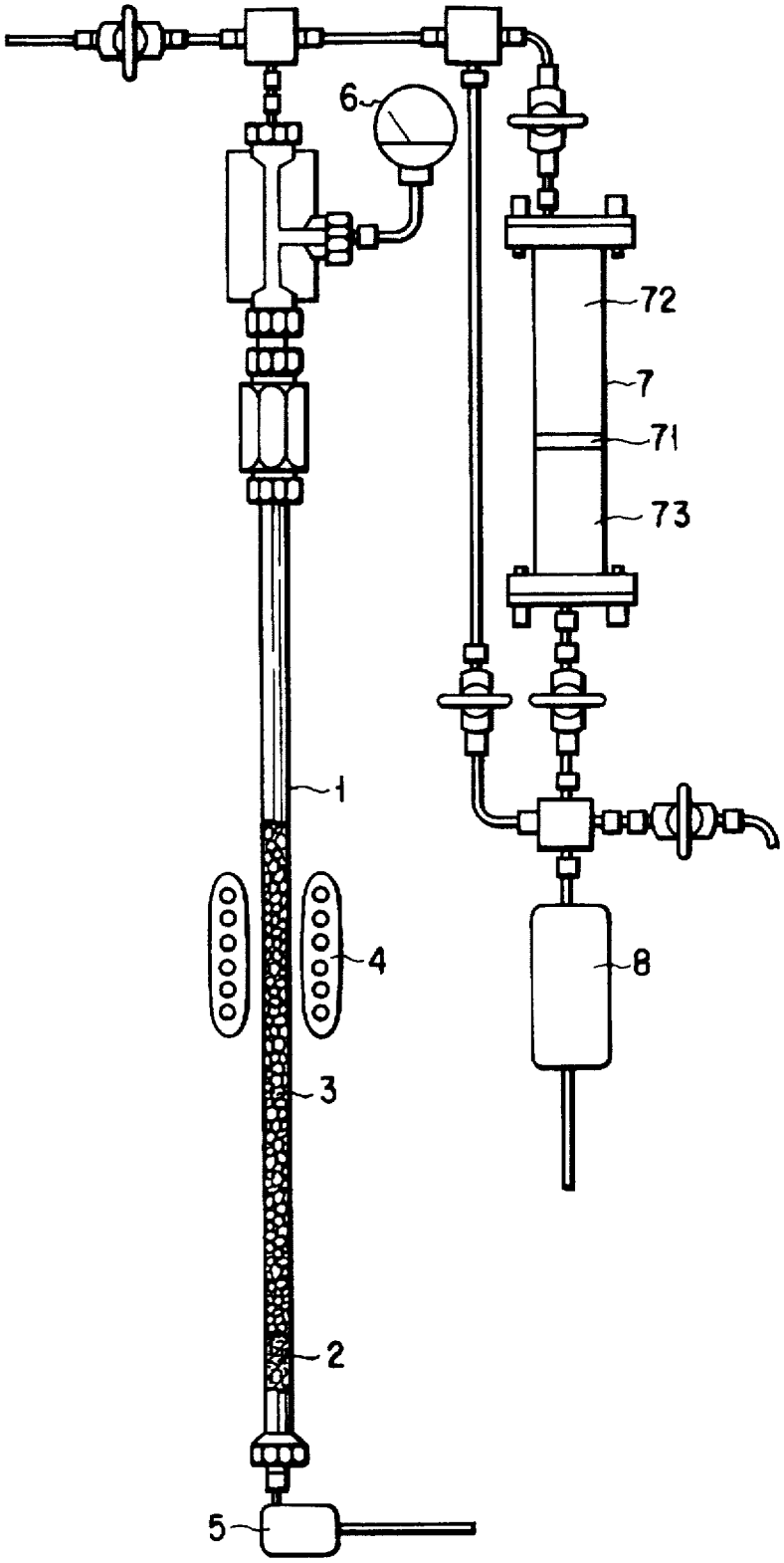
FIG. 2 is a structural view of the hydrothermal reaction device used in a simulation test for blocking cracks employing a blocking agent slurry of the present invention.

A simulation test for blocking rock cracks was performed using a thermal-gradient type hydrothermal reaction device. The cracks produced in the underground hot dry rocks can be simulated by this device. Referring to FIG. 2, the hydrothermal reaction device will be explained. In a tube reactor 1, glass wool 2 is packed in the bottom. On the glass wool 2, granite fragments 3 are charged. To the periphery of the middle portion of the tube reactor 1, a temperature controlling heater 4 is provided. On the lowermost end and the uppermost portion, a pressure control valve 5 and a pressure gauge 6 are provided, respectively. A slurry supply tube 7 is connected to the upper end of the tube reactor 1. To the slurry supply tube 7, a water pump 8 is connected. The inside of the slurry supply tube 7 is divided into two potions by a diaphragm 71. A starting slurry 72 is charged in the portion of the slurry supply tube 7 close to the tube reactor 1. Water 73 is contained in the portion close to the water pump 8. Water is fed from the water pump 8 into a slurry supply tube 7 and pushes the slurry 72 via the diaphragm 71, thereby supplying the slurry 72 into the tube reactor 1.

Figure 3:
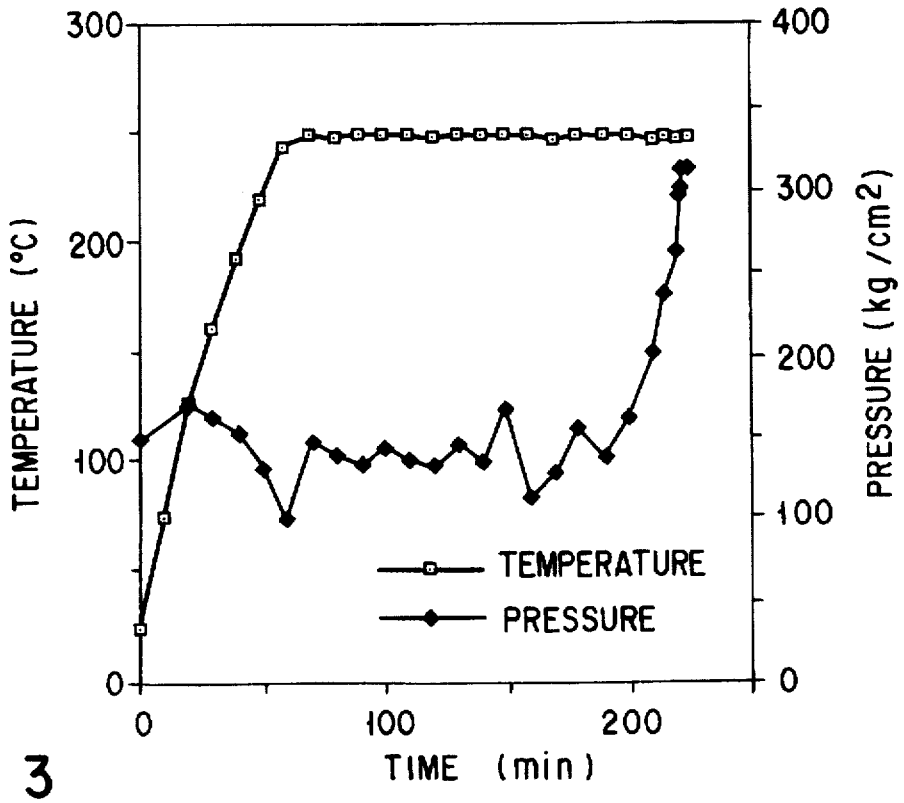
FIG. 3 is a diagram showing a change of the inner pressure of a reaction tube in a hydrothermal reaction device, when the reaction tube is continuously heated on the reaction temperature of 250° C. in a simulation test for blocking cracks performed by using a blocking agent slurry of the present invention.

First, water was supplied into the tube reactor 1 and middle portion of the tube reactor 1 was heated by the temperature controlling heater 4. After the temperature was attained to a reaction value, a valve was switched and the starting slurry 72 (hectorite concentration of 2%) was continuously supplied into the tube reactor 1 at a flow rate of 1 ml/min. During these operations, the inner pressure of the tube reactor 1 was monitored. FIG. 3 shows the change of the inner pressure when the reaction temperature was controlled to be 250° C.

As is evidenced in FIG. 3, after attained to the reaction temperature of 250° C., the inner pressure of the tube reactor 1 exhibits fluctuation. This fluctuation reflects the fact that the flowing path formed between granite fragments is partially blocked as hectorite produces. Furthermore, the inner pressure abruptly increases at 200 minutes after the initiation of the test (120 minutes after supplying of the starting slurry). This abrupt and great increase in the inner pressure demonstrates that the flowing path formed between granite fragments is completely blocked by a hectorite gel.

The complete blocking of the flowing path was observed in the same way as in FIG. 3 when a test was performed by controlling the reaction temperature of the tube reactor to be 200° C.

As is apparent from these results, the underground rock cracks can be blocked by the steps of allowing the blocking agent slurry according to the present invention to flow into the cracks produced in the underground rocks, and allowing hectorite synthesized from the raw materials contained in the slurry to gel under high temperature circumstances of underground.

Therefore, by using the blocking agent of the present invention it is possible to increase the recovery of the injected water and the heat extracting efficiency in a method of making artificial cracks in the underground hot dry rocks and supplying water from an injection well to recover hot water through a production well.

What is claimed is:

1. A method of blocking cracks artificially produced in hot dry rocks present at depth of underground, comprising the steps of:

injecting a slurry of blocking agent containing hectorite raw materials in an amount of 1 to 10 wt %, which comprises an acidic precipitate of water glass and magnesium chloride, sodium hydroxide, lithium hydroxide and water;

allowing the slurry to flow into the cracks produced in the underground hot dry rocks;

allowing hectorite synthesized from the raw materials contained in the slurry to gel under high temperature conditions of the underground, thereby blocking the cracks.

2. The method according to claim 1, wherein said hectorite synthesized under high temperature conditions of underground has a composition of $Na_{0.2-0.5}(Mg_{2.5-2.8}Li_{0.2-0.5})Si_4O_{10}(OH)_2 \cdot nH_2O$.

3. The method according to claim 1, wherein the temperature range of said high temperature conditions of underground is 200° to 250° C.

4. The method according to claim 1, wherein gelling of hectorite is performed by allowing said slurry of blocking agent to react for 1 to 3 hours.

* * * * *